United States Patent [19]

Petracek et al.

[11] Patent Number: 4,854,135

[45] Date of Patent: Aug. 8, 1989

[54] ANTIQUE SATIN WEFT INSERTED WARP KNIT DRAPERY FABRIC

[75] Inventors: Vaclav Petracek, Bayside, N.Y.; Julius Schnegg, Burlington, N.C.

[73] Assignee: Burlington Industries, Inc., Greensboro, N.C.

[21] Appl. No.: 29,555

[22] Filed: Mar. 24, 1987

Related U.S. Application Data

[63] Continuation-in-part of Ser. No. 784,555, Oct. 4, 1985, Pat. No. 4,682,480.

[51] Int. Cl.[4] ..... D04B 7/12

[52] U.S. Cl. ..... 66/190; 66/196; 66/192; 66/84 A

[58] Field of Search ..... 66/190, 195, 84 A, 85 A, 66/196

[56] References Cited

U.S. PATENT DOCUMENTS

| | | | |
|---|---|---|---|
| H90 | 7/1986 | Kumar | 66/192 |
| 2,890,579 | 6/1959 | Mauersberger | 66/192 |
| 3,102,042 | 8/1963 | Gortvai . | |
| 3,274,805 | 9/1966 | Duhl | 66/192 |
| 3,279,221 | 10/1966 | Gliksmann | 66/192 |
| 3,567,565 | 3/1971 | Jones et al. | 66/190 |
| 3,592,686 | 7/1971 | Barber et al. . | |
| 3,635,786 | 1/1972 | Hughes | 66/192 |
| 3,649,428 | 3/1972 | Hughes | 66/192 |
| 3,676,207 | 7/1972 | Lofton et al. . | |
| 3,713,868 | 1/1973 | Gordon et al. . | |
| 3,769,815 | 11/1973 | Ploch et al. | 66/192 |
| 4,277,527 | 7/1981 | Duhl . | |
| 4,304,812 | 12/1981 | Perkins . | |
| 4,307,145 | 12/1981 | Goldman . | |
| 4,399,670 | 8/1983 | Hittel et al. | 66/84 A |
| 4,437,323 | 3/1984 | Hittel et al. | 66/84 A |
| 4,450,196 | 5/1984 | Kamat | 2/272 |
| 4,571,956 | 2/1986 | Fiedler | 66/84 A |
| 4,608,290 | 8/1986 | Schnegg . | |
| 4,682,480 | 7/1987 | Schnegg | 66/192 |

FOREIGN PATENT DOCUMENTS

| | | | |
|---|---|---|---|
| 68316 | 8/1969 | German Democratic Rep. | 66/84 A |
| 2081757 | 6/1982 | United Kingdom . | |
| 2097829 | 5/1985 | United Kingdom . | |

OTHER PUBLICATIONS

Bahlo "New Fabrics Without Weaving", Modern Textiles Magazine, 11/1965, pp. 51–53.

Yanagawa et al., "Experimental Study on the Biaxial Tensile Properties. . . ", Journal of the Textile Machinery Society of Japan, 1970, 16, No. 4, pp. 126–135.

Reisch, "New Kodel Fiber Aimed at Drapery Market", HFD Retailing Home Furnishings, 58, No. 41:89, Oct. 8, 1984.

Lyle, "Antique Satin Draperies", American Drycleaner, No. 48, pp. 44–46.

*Primary Examiner*—Ronald Feldbaum

*Attorney, Agent, or Firm*—Nixon & Vanderhye

[57] ABSTRACT

A dry cleanable self-lined unfinished lustrous antique satin fabric having good hand, good crease resistance, and a woven look is provided. The fabric is a weft inserted warp knit (wiwk) fabric which has a multiple substrate, a single substrate with foam backing, or a single substrate with an additional sewn lining. The weft yarn is on the face of the substrate, and is a lustrous yarn such as rayon (as when producing non-washable draperies), or acrylic, bright polyester or acetate (as when producing washable draperies). The weft has a density equivalent to between about 36–52 single picker per inch, and at least part of the weft may comprise a novelty yarn. The warp yarn is stitching yarn, in a tricot stitch configuration. The warp yarn is a low-shrinkage filament yarn that is not fully oriented, and has a denier of between about 20–60, and an elongation of at least 15 percent. Non-woven inexpensive polyester substrate may be utilized; if a single layer is utilized it has a maximum weight of 2.0 ounces per square yard, and if a multiple substrate is utilized each layer has a maximum weight of between about 0.5–1.0 ounces per square yard.

57 Claims, 3 Drawing Sheets

FIG. 2
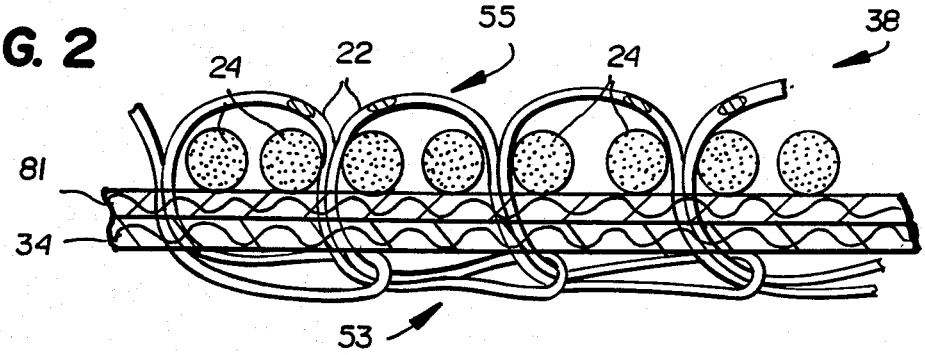
FIG. 3
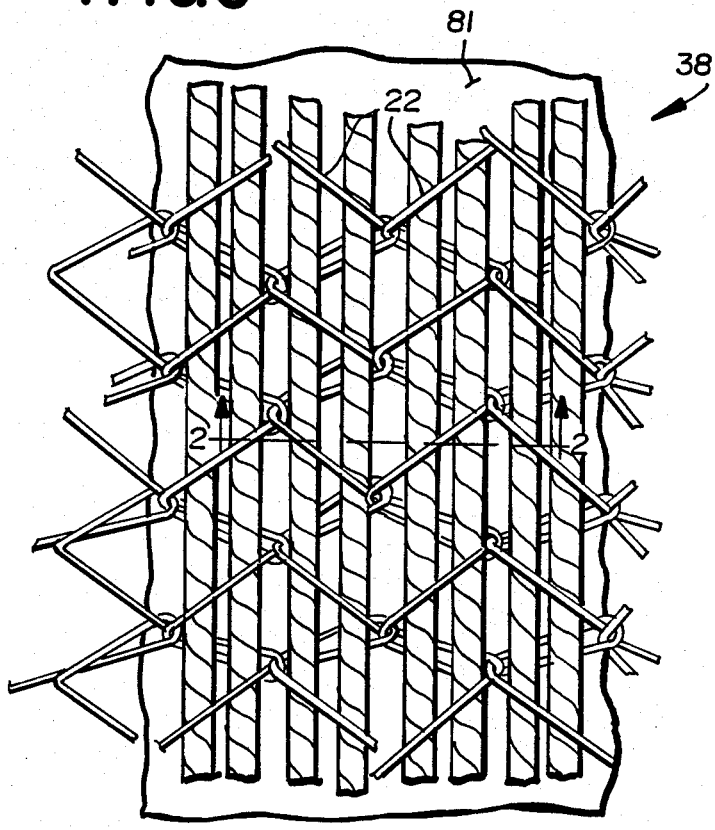
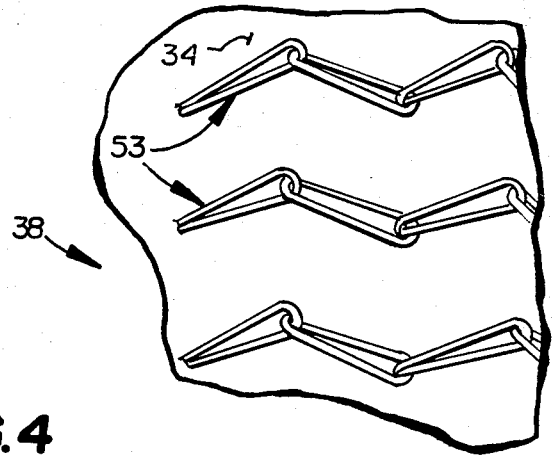
FIG. 4

ANTIQUE SATIN WEFT INSERTED WARP KNIT DRAPERY FABRIC

CROSS REFERENCE TO RELATED APPLICATION

This application is a continuation-in-part of application Ser. No. 784,555, filed Oct. 4, 1985, now U.S. Pat. No. 4,682,480.

BACKGROUND AND SUMMARY OF THE INVENTION

Antique satin fabrics are very popular for end uses such as draperies and upholstery. Antique satin fabrics are commonly produced by weaving a high sley warp and a dense filling (weft) yarn. The filling yarn typically comprises a variety of plain and novelty yarns which create a pattern, and the warp yarn may be plain and hidden, or with a subdued warp effect, so that the filling effect dominates the pattern. Pricing is very competitive in the antique satin market, and it is customary to sell "off loom" (unfinished) fabrics that pass dry cleaning tests.

Because of the filling oriented construction of the face of antique satin fabrics, the price competitiveness of the market, and their "off loom" sales, heretofore commercially significant attempts at producing antique satin fabrics on weft inserted warp knitting machines have not existed. In fact, there are numerous practical difficulties in producing antique satin weft inserted warp knit (wiwk) fabrics. For example, if conventional stitching configurations are utilized, vertical lines will be formed on top of the weft yarns (e.g. chain stitching), or the stitching will have insufficient stability (e.g. satin stitching).

It was found that such antique satin fabrics require a very delicately balanced construction encompassing stitching yarn, stitching construction, and substrates.

A major problem that had to be overcome was the selection of the right yarn and substrate combination . Some stitching yarns slit the substrate into strips congruent to the gauge of the machine, because the fabric needed to be knitted so tightly. Another substrate, that did not slit, worsened the dry clean shrinkage results to the point that they become unacceptable. Therefore, it was necessary to bring yarn properties and substrate properties into an equilibrium.

After desirable yarn—substrate combinations were found there was a need for even more opacity since the fabric would probably be acceptable commercially only if it could be sold truly self-lined. This is an important cost advantage. It was found that plied (2 or more) layers of ordinary substrates will be sufficiently opaque to act as self-lining. A plied substrate was preferred over a single substrate of same weight, since the plied substrates appear more opaque than a single substrate of same weight. Also, the hand of a plied substrate is more desirable.

According to the present invention, it has been found that by selecting the appropriate warp stitching yarn for a weft inserted warp knit fabric, an antique satin fabric can be produced which is very pleasing aesthetically, and is a suitable substitute from the aesthetic standpoint for conventional woven antique satin fabrics in common end uses such as draperies and upholstery. Surprisingly, however, the antique satin wiwk fabric according to the invention is also dry cleanable (having acceptable dry cleaning and shrinkage properties), has excellent hand, better luster than the conventional woven equivalents, better dry crease resistance compared to conventional woven equivalents, and can be produced at a much lower cost. Thus the antique satin fabric according to the present invention has no significant drawbacks compared to conventional antique satin fabrics, and has numerous advantages.

The fabric according to the present invention includes one or more substrate layers. If a multiple substrate is provided, each layer may have a weight between about 0.5–1.0 ounces per square yard. Ordinary, inexpensive, washable and dry cleanable polyester nonwoven substrates may be utilized. Although spun-laced, and like more expensive substrates can be utilized, there is normally no significant advantage in their utilization.

The weft or filling yarn according to the fabric of the invention is on the face of the substrate, and is lustrous. For example, where a non-washable drapery fabric is being produced, the weft yarn may comprise rayon, or a blend of rayon with other yarns, so that the filling has lustrous properties comparable to those of rayon. It is a characteristic of antique satin to be lustrous, but if desired non-lustrous material can also be used. If adequate finishing formulas are found, a 100 percent rayon filling may be made washable, too.

Washable drapery fabric can be produced with thermoplastic filling yarns. Some of the weft yarns may be novelty yarns to create a patterned effect, which is especially desirable when the antique satin fabric is used to produce draperies. The filling construction has a high density, for example a density equivalent of between about 36–56 single picks per inch (about 52 picks being preferred).

Preferably, no laid-in warp yarn is utilized. The warp yarn that is provided is stitching yarn having a fine denier. The stitching yarn must have low shrinkage and an elongation of at least 15 percent (preferably about 30–70 percent). Typically a non-fully oriented polyester filament yarn with a denier between about 20–60 (40–50 being preferred) is utilized. Other, possibly fully oriented polyester filament yarns may be found to be feasible.

The antique satin fabric according to the present invention is preferably unfinished. It typically (e.g. for a double polyester substrate and a 100 percent rayon weft) has excellent crease resistance, i.e. a crease resistance rating of about 3.0, where 5.0 is perfect, and conventional woven antique satin fabrics have a crease resistance rating of between about 2.0–2.5. The fabric according to the present invention is made into self-lined draperies, e.g. 84 inches in length; that can be produced at a price that is only about $\frac{1}{2}$–$\frac{3}{4}$the price for conventional woven antique satin separately lined draperies.

It is the primary object of the present invention to provide an antique satin fabric having advantages compared to conventional woven antique satin fabrics, particularly in the production of draperies, upholstery, and the like. This and other objects of the invention will become clear from an inspection of the detailed description of the invention, and from the appended claims.

BRIEF DESCRIPTION OF THE DRAWINGS

FIG. 2 is a schematic side cross-sectional view illustrating an examplary piece of antique satin fabric according to the invention;

FIG. 3 is a top plan view of the fabric of FIG. 2;

FIG. 4 is a bottom view of the fabric of FIGS. 2 and 3;

DETAILED DESCRIPTION OF THE DRAWINGS

Figure 1:
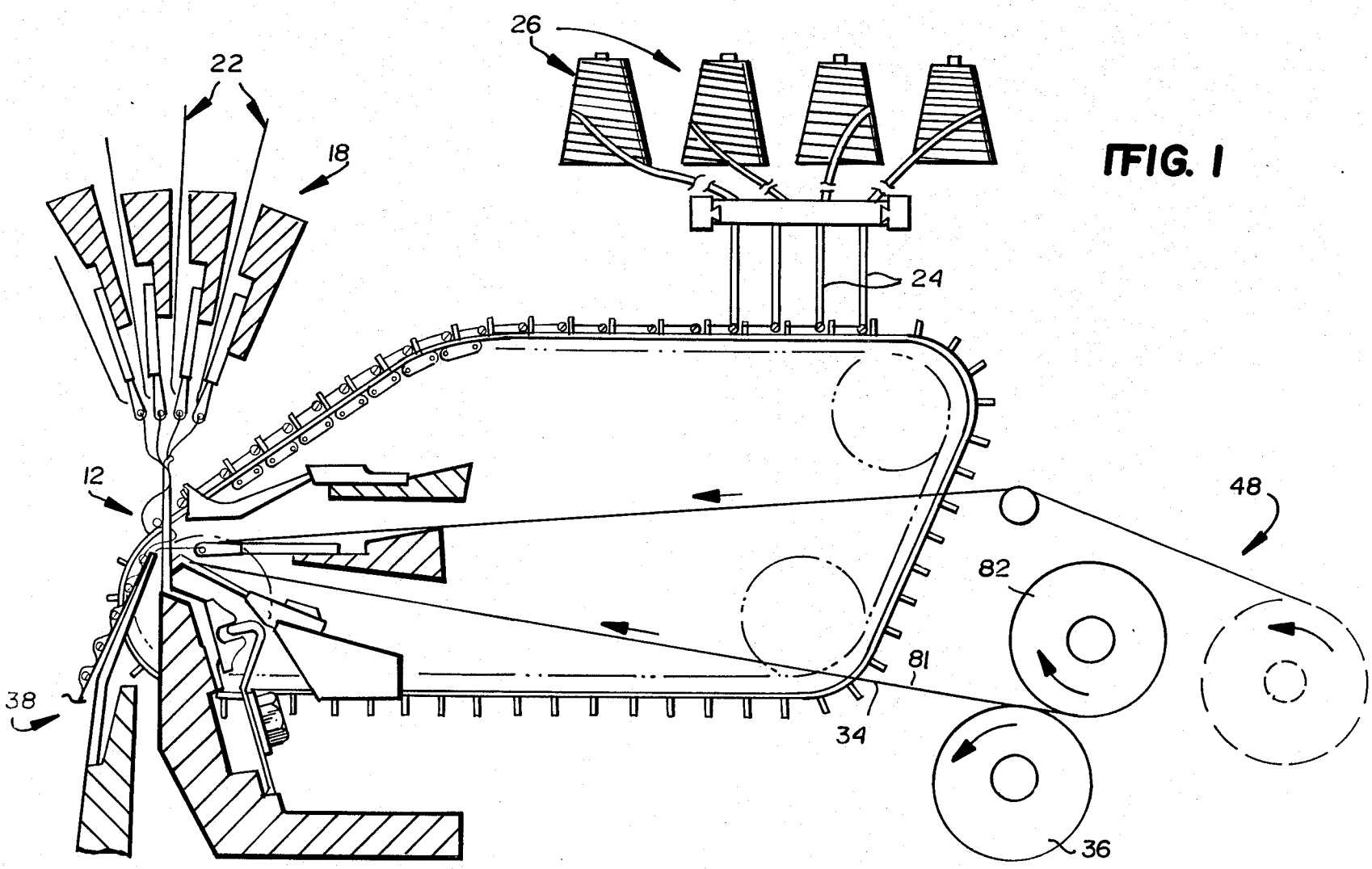
FIG. 1 is a side schematic view, partly in cross-section and partly in elevation, diagrammatically illustrating apparatus utilized in the production of antique satin drapery according to the present invention.

The apparatus illustrated in FIG. 1 is basically the same type of apparatus as in said parent application Ser. No. 784,555 filed Oct. 4, 1985 except for the fact that the embodiment in FIG. 1 illustrates two substrate feeds, and a laid-in warp feed 48 is shown only in dotted line since it is optional and in most cases undesirable. High luster (brightness) weft yarns 24 (or any other luster, if needed) are fed from cones 26 to the knitting area 12, while the low shrinkage, high elongation warp knitting yarn 22 is fed via guide bars 18 to the knitting area 12. A first substrate 34 is fed from reel 36, while a second substrate 81 is fed in face-to-face engagement with first substrate 34, from reel 82. The resulting antique satin wiwk fabric 38 is illustrated in FIGS. 2 through 4.

The fabric 38 includes the substrates 81, 34. When two substrates are utilized, as preferred, each of the substrates 81, 34 has a weight between about 0.5–1.0 ounces per square yard. If a single layer is used it preferably has a maximum weight of about 2.0 ounces per square yarn. Preferably the substrates are ordinary, washable and dry cleanable polyester non-woven substrates, although spun-lace substrates or the like may be utilized even though they are more expensive and normally do not add any significant advantage, and woven substitutes may also be utilized. One exemplary substrate that is inexpensive yet entirely suitable for production of antique satin fabric according to the invention is a non-woven substrate, style 6812, from Scott Paper Company. The substrates 81, 34 may have the same properties, or they may be different types of substrates, having different properties.

The weft or filling yarns 24 in the fabric 38 are on the face of the substrate 81, 34. The filling yarns 24 are preferably lustrous yarns. For example, where the fabric 38 is to be non-washable (e.g. a non-washable drapery), the yarns 24 may be rayon or a blend of rayon and polyester, etc. Other yarns having the same lustrous properties as rayon are also suitable. Where the fabric 38 is to be washable, non-cellulosic filling yarns 24 are preferably utilized. It is understood, that finishing procedures may be changed to make a washable, rayon weft only, antique satin. Non-cellulosic lustrous filling yarns include acrylic, acetate, bright polyester, blends thereof, or other yarns having substantially the same properties as those yarns. The yarns 24 are provided in a relatively high density configuration. For example, the density thereof would be equivalent to about 36–56 single picks per inch. A density of about 52 single picks per inch is preferred. The yarns 24 may include some (or even all) novelty yarns. Especially when draperies are being produced, it is desirable to have some of the filling yarns 24 as novelty yarns (e.g. slub yarns).

The warp stitching yarn 22 includes stitch loops 53 which are on the technical face side of the substrate 81, 34 while the stitch underlap 55 is over the weft yarns 24. The stitch loops 53, as illustrated schematically in FIG. 4, are in a configuration that is dimensionally stable and non-patterning (unlike satin stitching), yet does not cause vertical lines to be formed on top of the weft yarns in the final fabric (as is caused by chain stitching). As illustrated in FIG. 4, the stitch configuration preferably is a tricot stitch configuration.

The warp stitching yarns 22 are low shrinkage and have high elongation. Preferably they are synthetic yarns that have not been fully oriented, such as not fully oriented polyester. Other yarns of similar properties may also be used. The elongation of the warp yarns must be at least 15 percent, and preferably elongation is over 30 percent (e.g. 70 percent). The stitching yarn also has a fine denier, a filament yarn denier of 20–60 being desirable, with 40–50 preferred (particularly a denier of 50). Typical desirable yarns are the low shrink 50/34 types 654 or 557 polyester yarn from DuPont, which have an elongation of about 70 percent.

As can be seen in FIG. 3, the antique satin fabric 38 according to the invention is substantially comparable to conventional woven antique satin fabric, particularly when formed in a drape—except that it has slightly better luster. The fabric 38 according to the invention has good hand, a woven look, and good crease resistance. As a matter of fact in testing of a 78/22 rayon/-polyester weft inserted antique stain fabric according to the invention (PD630/PD576 self-lined with a double layer of polyester/substrate) it was found to have a crease resistance rating of about 3.0, which is significantly better than for common woven antique satin drapery fabrics which were tested, which had crease resistance ratings between about 2.0 and 2.5.

In addition to having the advantages discussed above, the fabric 38 according to the invention also can be produced at a cost much lower than the cost of conventional woven antique satin fabrics.

Figure 5:
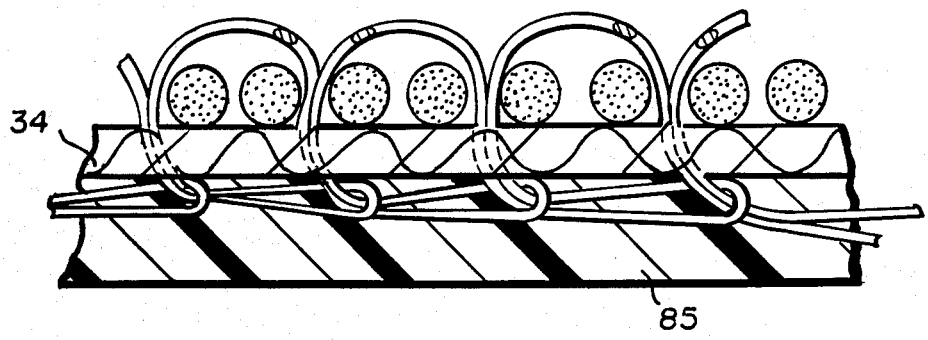
FIG. 5 is a side schematic cross-sectional view of another embodiment of the fabric according to the invention, having a single substrate layer and foam backing.
Figure 6:
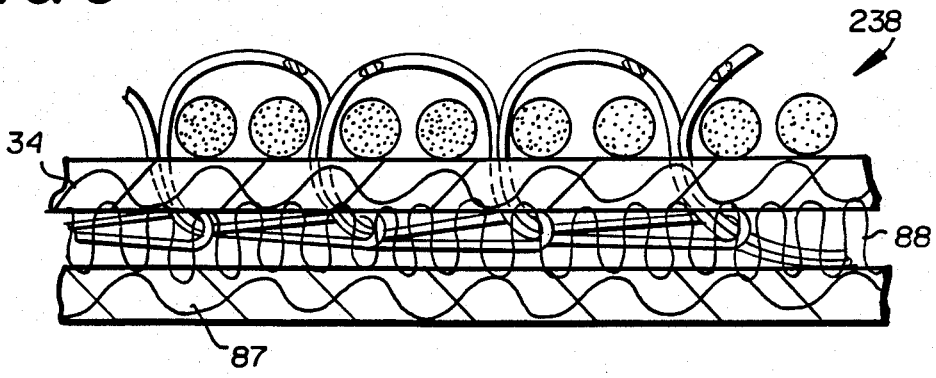
FIG. 6 is a side schematic cross-sectional view of another embodiment of fabric according to the invention having a single layer of substrate with a sewn lining attached thereto.

FIGS. 5 and 6 illustrate two other embodiments of the fabric according to the invention. In FIG. 5, the fabric 138 includes the filling and warp knitting yarns and the first substrate 34, and a foam backing 85 is applied to the fabric after formation, the foam backing being applied by conventional techniques. The single substrate 34 preferably has the same properties as when a double substrate is utilized (e.g. a polyester washable, dry cleanable non-woven), and preferably has a maximum weight of about 2.0 ounces per square yard.

The fabric 238 in FIG. 6 also has filling yarns, warp knitting yarns, and a single substrate 34. It also has a lining 87 that is sewn, as by the thread illustrated schematically at 88, to the rest of the fabric 238, particularly the substrate 34.

Figure 7:
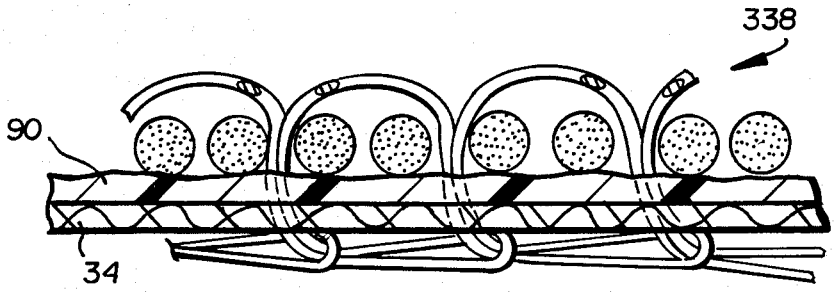
FIG. 7 is a side schematic cross-sectional view of yet another embodiment, showing a single substrate layer and a low melting point material layer between the warp and substrate.

In yet another embodiment, as shown in FIG. 7, primarily utilized in upholstery, a sheet of low melting point synthetic material 90, such as a polyethylene sheet, can be placed between a single substrate 34 and the filling yarn 24. During processing the fabric 338 is subjected to heat (e.g. by a calendar roll), which causes the polyethylene sheet 90 to become "tacky" and causes it to tightly hold the filling yarns 24 in place.

It is preferred that the fabric 38 according to the present invention be unfinished, and that there be no laid-in warp yarns. However under some circumstances to obtain different effects, or for particular end uses, laid-in warp yarns can be provided, utilizing the apparatus 48 illustrated in FIG. 1.

According to the invention, for the first time antique satin fabrics can also be produced with a combination of spun and filament weft yarns (having significant amounts of each). When weaving an antique satin fabric, as according to the prior art, it has been impossible to mix such types of yarns. However, that is possible in the production of antique satin fabric according to the invention. A rather dull spun yarn, such as cotton or a polyester cotton yarn, can be used to give color to the fabric, with a lustrous nylon or polyester filament yarn used to give sheen. Or, for example, iridescent nylon yarns can be interpersed with spun yarns. Thus an entirely novel fabric can be produced.

Desirable dry shrinkage properties also can be achieved according to the invention in other, alternative, ways. Warp stitching yarn can be utilized which has a dry shrinkage of 3 percent or less (preferably about 2 percent) with high elongation, preferably over 25 percent. For example a partially oriented yarn draw-warped and stabilized to the desired properties can be utilized. That is a method of making an antique satin fabric is provided comprising the steps of: (a) providing a substrate of at least one layer; (b) inserting weft yarn on the face of the substrate using weft inserted warp knitting machine; and (c) using a yarn with a dry shrinkage of about 3 percent or under, and with an elongation of greater than about 25 percent, and a denier between about 20–60, warp stitching the weft yarn onto the substrate, said warp stitching being provided in a stitch configuration such that vertical lines on top of the weft yarns are avoided, yet the stitch configuration is dimensionally stable.

As a second alternative, the fabric itself, in loom state, may be heat set. Any high elongation yarn with a denier of between about 20–60 (to provide low visibility on the filling yarn) can be heat set and thus dry cleaned satisfactorily. That is, a method of making an antique satin fabric is provided comprising the steps of: (a) providing a substrate; (b) weft-inserting warp knitting a fabric utilizing weft yarn on the face of the substrate having a density equivalent to between about 36–56 single picks per inch, and warp stitching yarn; (c) stitching the weft yarn to the substrate with the warp stitching yarn in a configuration such that vertical lines on top of the weft yarns are avoided, yet the stitch configuration is dimensionally stable, to provide an antique satin fabric; and (d) heat setting the fabric.

It will thus be seen that according to the present invention an advantageous antique satin fabric, particularly suited for manufacture into draperies and upholstery, has been provided. While the invention has been herein shown and described in what is presently conceived to be the most practical and preferred embodiments thereof it will be apparent to those of ordinary skill in the art that many modifications may be made thereof within the scope of the invention, which scope is to be accorded the broadest intepretation of the appended claims so to encompass all equivalent fabrics, methods, and products.

What is claimed is:

1. A weft inserted warp knit antique satin fabric comprising:

a substrate having multiple layers, with a maximum weight of between about 0.5–1.0 ounces per square yard for each said layer;

weft yarn on the face of said substrate, having a density equivalent to between about 36–56 single picks per inch;

warp stitching yarn having low shrinkage and an elongation of at least 15 percent, and a denier between about 20–60; and said warp stitching yarn provided in a stitch configuration such that vertical lines on top of the weft yarns are avoided, yet the stitch configuration is dimensionally stable.

2. An antique satin fabric as recited in claim 1 wherein each substrate layer is washable and dry cleanable non-woven polyester substrate.

3. An antique satin fabric as recited in claim 1 wherein the fabric is non-washable, and the weft yarns are lustrous, having lustrous properties comparable to rayon.

4. An antique satin fabric as recited in claim 1 wherein the fabric is washable, and wherein said weft yarn has lustrous properties comparable to non-cellulosic yarns selected from the group consisting of acrylic, bright polyester, acetate, and blends thereof.

5. An antique satin fabric as recited in claim 4 wherein at least some of said weft yarns are novelty yarns.

6. An antique satin fabric as cited in claim 3 wherein at least some of said weft yarns are novelty yarns.

7. A antique satin fabric as recited in claim 1 wherein said warp yarn has a dry shrinkage of less than about 3 percent and an elongation of at least about 25 percent.

8. An antique satin fabric as recited in claim 7 wherein said warp yarn has a denier of between about 40–50.

9. An antique satin fabric as recited in claim 8 wherein said warp yarn is a polyester yarn having an elongation of approximately 70 percent and a denier of about 50.

10. An antique satin fabric as recited in claim 9 wherein the stitching configuration of said warp yarn is tricot stitching.

11. An antique satin fabric as recited in claim 10 wherein a multiple substrate is provided, each layer of the multiple substrate having a weight between about 0.5–1.0 ounces per square yard.

12. An antique satin fabric as recited in claim 1 wherein the stitching configuration of said warp yarn is tricot stitching.

13. An antique satin fabric as recited in claim 1 further comprising a foam backing on a back face of said substrate, opposite said face of said substrate on which said weft yarn is disposed.

14. An antique satin fabric as recited in claim 1 and further comprising an additional sewn lining attached to the back face of said substrate, opposite the face on which said weft yarn is disposed.

15. An antique satin fabric as recited in claim 1 wherein said fabric is unfinished, and wherein said fabric consists of said weft yarn, warp stitching yarn, and substrate.

16. An antique satin fabric as recited in claim 13 wherein said fabric is unfinished, and wherein said fabric consists of said weft yarn, said warp stitching yarn, said substrate, and said foam backing.

17. An antique satin fabric as recited in claim 14 wherein said fabric is unfinished and wherein said fabric consists of said weft yarn, said warp stitching yarn, said substrate, and said sewn lining.

18. An antique satin fabric as recited in claim 1 further comprising a low melting point synthetic material sheet disposed between said substrate and said weft yarn, said low melting point synthetic material providing means for holding tight the weft of the fabric construction.

19. A dry cleanable self-lined unfinished lustrous antique satin fabric having good hand, good crease resistance, and a woven look, comprising a multiple substrate warp knit weft inserted antique satin fabric.

20. A dry cleanable self-lining unfinished lustrous antique satin drapery having good hand, good crease resistance, and a woven look, comprising a multiple warp knit weft inserted antique satin fabric.

21. A dry cleanable self-lined unfinished lustrous antique satin fabric having good hand, good crease resistance, and a woven look, comprising a warp knit weft inserted antique satin fabric having a single foam backed substrate.

22. A dry cleanable self-lined unfinished lustrous antique satin drapery having good hand, good crease resistance, and a woven look, comprising a warp knit weft inserted antique satin fabric having a single foam backed substrate.

23. A dry cleanable self-lined unfinished lustrous antique satin fabric having good hand, good crease resistance, and a woven look, comprising a warp knit weft inserted antique satin fabric with a substrate and a lining sewn to the substrate.

24. A dry cleanable self-lined unfinished lustrous antique satin drapery having good hand, good crease resistance, and a woven look, comprising a warp knit weft inserted fabric with a substrate and a lining sewn to the substrate.

25. An antique satin fabric as recited in claim 2 wherein each of said substrates has different properties than the other.

26. An antique satin fabric as recited in claim 20 wherein each of said substrates has different properties than the other.

27. An antique satin fabric as recited in claim 20 wherein at least some of the weft yarns are novelty yarns.

28. An antique satin fabric as recited in claim 1 wherein at least some of the weft yarns are novelty yarns.

29. An antique satin fabric as recited in claim 2 wherein said weft yarn is rayon and wherein said fabric has a crease resistance rating of about 3.0.

30. A weft inserted warp knit antique satin fabric comprising:

a substrate having at least one layer;

weft yarns on the face of said substrate, having a density equivalent to between about 36–56 single picks per inch, said weft yarns including a mixture of a significant amount of both spun and filaments yarns;

warp stitching yarn having low shrinkage and high elongation; and said warp stitching yarn provided in a stitch configuration such that vertical lines on top of the weft yarns are avoided, yet the stitch configuration is dimensionally stable.

31. An antique satin fabric as recited in claim 30 wherein said spun yarns are relatively dull, but supply color, and wherein said filament yarns are lustrous, or even iridescent.

32. An antique satin fabric as recited in claim 31 wherein said spun yarns are selected from the group consisting essentially of cotton and cotton polyester blends and wherein said filament yarn is selected from the group consisting essentially of lustrous nylon, lustrous polyester, acetate, and iridescent nylon.

33. An antique satin fabric as recited in claim 30 wherein said warp stitching yarn has an elongation of at least 15 percent and a denier between about 20–60.

34. An antique satin fabric as recited in claim 30 wherein said warp stitching yarn has a dry shrinkage of about 3 percent or less, and has an elongation of about 25 percent or more.

35. An antique satin fabric as recited in claim 33 wherein said substrate has a maximum weight of

36. A weft inserted warp knit antique satin fabric comprising:

a substrate having a single layer with a maximum weight of about 2.0 ounces per square yard;

weft yarn on the face of said substrate, having a density equivalent to between about 36–56 single picks per inch;

warp stitching yarn having low shrinkage and an elongation of at least 15 percent, and a denier between about 20–60; and said warp stitching yarn provided in a stitch configuration such that vertical lines on top of the weft yarns are avoided, yet the stitch configuration is dimensionally stable.

37. An antique satin fabric as recited in claim 36 wherein each substrate layer is a washable and dry cleanable non-woven polyester substrate.

38. An antique satin fabric as recited in claim 36 wherein the fabric is non-washable, and the weft yarns are lustrous, having lustrous properties comparable to rayon.

39. An antique satin fabric as recited in claim 36 wherein the fabric is washable, and wherein said weft yarn has lustrous properties comparable to non-cellulosic yarns selected from the group consisting of acrylic, bright polyester, acetate, and blends thereof.

40. An antique satin fabric as recited in claim 39 wherein at least some of said weft yarns are novelty yarns.

41. An antique satin fabric as recited in claim 40 wherein at least some of said weft yarns are novelty yarns.

42. An antique satin fabric as recited in claim 36 wherein said warp yarn has a dry shrinkage of less than about 3 percent and an elongation of at least about 25 percent.

43. An antique satin fabric as recited in claim 42 wherein said warp yarn has a denier of between about 40–50.

44. An antique satin fabric as recited in claim 43 wherein said warp yarn is a polyester yarn having an elongation of approximately 70 percent and a denier of about 50.

45. An antique satin fabric as recited in claim 44 wherein the stitching configuration of said warp yarn is tricot stitching.

46. An antique satin fabric as recited in claim 43 wherein a multiple substrate is provided, each layer of the multiple substrate having a weight between about 0.5–1.0 ounces per square yard.

47. An antique satin fabric as recited in claim 36 wherein the stitching configuration of said warp yarn is tricot stitching.

48. An antique satin fabric as recited in claim 36 further comprising a foam backing on a back face of said substrate, opposite said face on which said weft yarn is disposed.

49. An antique satin fabric as recited in claim 36 further comprising an additional sewn lining attached to a back face of said substrate, opposite the face on which said weft yarn is disposed.

50. An antique sating fabric as recited in claim 36 wherein said fabric is unfinished, and wherein said fabric consists of said weft yarn, warp stitching yarn, and substrate.

51. An antique satin fabric as recited in claim 48 wherein said fabric is unfinished, and wherein said fabric consists of said weft yarn, said warp stitching yarn, said substrate, and said foam backing.

52. An antique satin fabric as recited in claim 49 wherein said fabric is unfinished and wherein said fabric consists of said weft yarn, said warp stitching yarn, said substrate, and said sewn lining.

53. An antique satin fabric as recited in claim 36 further comprising a low melting point synthetic material sheet disposed between said substrate and said weft yarn, said low melting point synthetic material sheet providing means for holding tight the weft of the fabric construction.

54. A dry cleanable self-lined unfinished lustrous fabric having good hand, good crease resistance, and a woven look, comprising a multiple substrate stitch bonded antique satin fabric.

55. A dry cleanable self-lined unfinished lustrous drapery having good hand, good crease resistance, and a woven look comprising a multiple substrate stitch bonded antique satin fabric.

56. A dry cleanable self-lined unfinished lustrous fabric having good hand, good crease resistance, and a woven look comprising a stitch bonded antique satin fabric having a single foam backed substrate.

57. A dry cleanable self-lined unfinished lustrous drapery having a good hand, good crease resistance, and a woven look comprising a stitch bonded antique satin fabric having a single foam backed substrate.

* * * * *